US007699062B2

(12) United States Patent
Sasaki

(10) Patent No.: US 7,699,062 B2
(45) Date of Patent: Apr. 20, 2010

(54) SOLID COSMETIC MATERIAL CONTAINER

(75) Inventor: Arata Sasaki, Tokyo (JP)

(73) Assignee: Tokiwa Corporation, Gifu (JP)

( * ) Notice: Subject to any disclaimer, the term of this patent is extended or adjusted under 35 U.S.C. 154(b) by 1043 days.

(21) Appl. No.: 11/373,099

(22) Filed: Mar. 13, 2006

(65) Prior Publication Data

US 2006/0201838 A1 Sep. 14, 2006

(30) Foreign Application Priority Data

Mar. 14, 2005 (JP) ..... 2005-071397

(51) Int. Cl.
*A45D 33/02* (2006.01)

(52) U.S. Cl. ..... 132/298

(58) Field of Classification Search ..... 132/317, 132/318, 293–307; 424/69, 682; 206/823, 206/581, 521, 587, 592, 229, 235; 401/265, 401/266, 130, 72, 175; 220/727; 221/186, 221/221, 201, 277; 222/161
See application file for complete search history.

(56) References Cited

U.S. PATENT DOCUMENTS 1,616,696 A * 2/1927 MacDonald ..... 401/130
1,804,943 A * 5/1931 Maillard ..... 132/299
2,035,290 A * 3/1936 Bauer ..... 132/299
5,603,340 A * 2/1997 Gueret ..... 132/293
5,884,637 A * 3/1999 Joulia ..... 132/318
6,164,293 A * 12/2000 Gueret ..... 132/294

* cited by examiner

*Primary Examiner*—Robyn Doan
*Assistant Examiner*—Brianne E O'Neill
(74) *Attorney, Agent, or Firm*—Bacon & Thomas, PLLC

(57) ABSTRACT

To prevent damage of a solid cosmetic material in a container, a solid cosmetic material holding body (1) provided with a tubular installed portion (1*a*) installed in a container main body (2), a tubular elastic body (1*c*) connected to a lower side of the installed portion (1*a*) and is constituted by a resin spring expanding and contracting vertically by slits if and a holding portion (1*b*) arranged inside the installed portion (1*a*), provided with plural legs (1*j*) extending vertically and arranged apart from each other in a peripheral direction, is installed within the container main body (2) , wherein upper portions (1*k*, 1*m*) of the legs (1*j*) hold a solid cosmetic material (G) having a dome-shaped convex portion (G2) in such a manner that the convex portion (G2) protrudes upward and lower portions of the legs (1*j*) are coupled to a lower portion of the resin spring (1*c*).

4 Claims, 10 Drawing Sheets

SOLID COSMETIC MATERIAL CONTAINER

TECHNICAL FIELD

The present invention relates to a solid cosmetic material container structured such as to hold a solid cosmetic material having a dome-shaped convex portion.

BACKGROUND ART

Conventionally, there has been known a solid cosmetic material container structured such that a solid cosmetic material holding body holding a solid cosmetic material having a dome-shaped convex portion is installed in an inner portion of a container main body in such a manner that a convex portion is protruded to an upper side (refer, for example, to patent document 1, Japanese Unexamined Patent Publication No. 2004-321410).

DISCLOSURE OF THE INVENTION

Problem to be Solved by the Invention

In the solid cosmetic material container mentioned above, if an external force, for example, an impact caused by a drop or the like, a vibration or the like is applied to the solid cosmetic material container, there is a risk that a crack or a chip is generated in the solid cosmetic material, and there is a risk that the solid cosmetic material breaks away from the container.

The present invention is made for solving the problem mentioned above, and an object of the present invention is to provide a solid cosmetic material container in which it is possible to prevent a crack and a chip of a solid cosmetic material and prevent breaking away of the solid cosmetic material from the container, at a time when the external force, for example, the impact due to the drop or the like, the vibration or the like is applied.

Means for Solving the Problem

In accordance with the present invention, there is provided a solid cosmetic material container structured such that a solid cosmetic material holding body holding a solid cosmetic material having a dome-shaped convex portion is installed in an inner portion of a container main body in such a manner that the convex portion is protruded to an upper side, wherein the solid cosmetic material holding body comprises:

an installed portion formed in a tubular shape and installed in the container main body;

a holding portion arranged in an inner side of the installed portion and holding the solid cosmetic material; and an elastic body formed in a tubular shape, arranged in a lower side of the installed portion and connecting the installed portion and the holding portion, wherein the elastic body is constituted by a resin spring having slits in which a peripheral wall is opened and freely expanding and contracting in a vertical direction, wherein the holding portion has a plurality of legs extending in the vertical direction and arranged apart from each other in a peripheral direction, and wherein upper portions of the legs hold the solid cosmetic material and lower portions of the legs are coupled to a lower portion of the resin spring.

In accordance with the solid cosmetic material container mentioned above, the solid cosmetic material holding body provided with the installed portion, the elastic body and the holding portion is installed in the inner portion of the container main body, the installed portion is formed in the tubular shape and is installed in the container main body, the elastic portion is constituted by the resin spring which is connected to the lower side of the installed portion while being formed in the tubular shape and freely expands and contracts in the vertical direction and having the slit in which the peripheral wall is opened, the holding portion is provided with a plurality of legs which are arranged in the inner side of the installed portion, extend in the vertical direction and are arranged apart from each other, the upper portions of the legs hold the solid cosmetic material having the dome-shaped convex portion in such a manner that the convex portion protrudes to the upper side, and the lower portions of the legs are coupled to the lower portion of the resin spring. Accordingly, if the external force, for example, the impact due to the drop or the like, the vibration or the like is applied, the external force transmitted to the solid cosmetic material from the container main body is buffered by the resin spring of the solid cosmetic material holding body between the container main body and the solid cosmetic material, and it is possible to prevent the crack and the chip of the solid cosmetic material, and prevent breaking away of the solid cosmetic material from the container.

In this case, if the solid cosmetic material holding body is constituted by an integrally molded product by a resin, it is possible to reduce a manufacturing cost for molding, assembling or the like.

Further, in the case of the solid cosmetic material being in a gel state, the solid cosmetic material tends to be easily cracked and chipped in comparison with a solid cosmetic material including a fine particle and further including an oil and a wax. Accordingly, the structure is particularly effective.

Effect of the Invention

As mentioned above, in accordance with the present invention, since the external force transmitted to the solid cosmetic material from the container main body is buffered by the resin spring at a time when the external force, for example, the impact due to the drop or the like, the vibration or the like is applied, it is possible to prevent the crack and the chip of the solid cosmetic material, and prevent breaking away of the solid cosmetic material from the container.

BEST MODE FOR CARRYING OUT THE INVENTION

Figure 1:
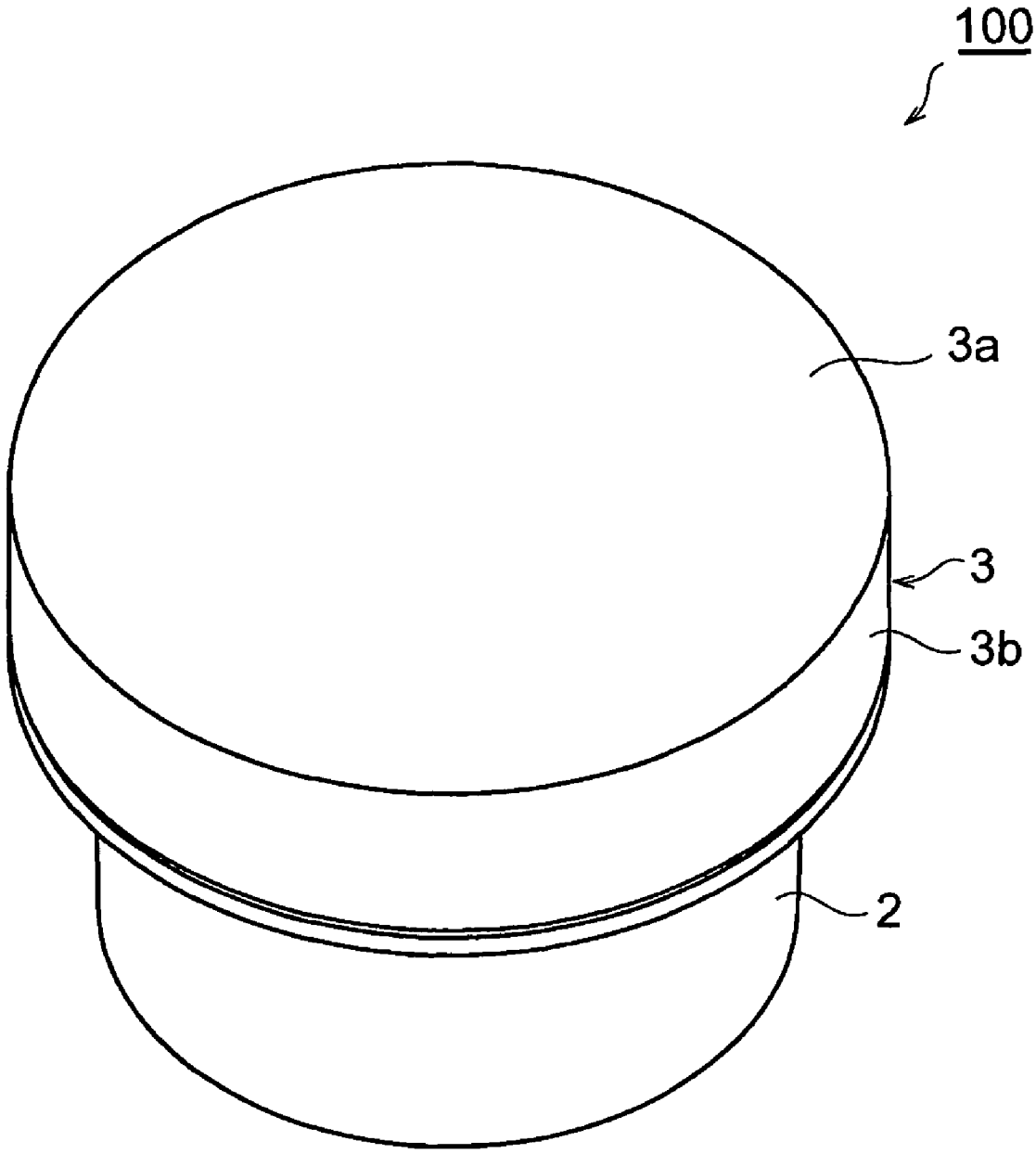
FIG. 1 is a perspective view showing a solid cosmetic material container in accordance with an embodiment of the present invention.

A description will be given below of a preferable embodiment of a solid cosmetic material container in accordance with the present invention with reference to FIGS. 1 to 8. In this case, in each of the drawings, the same reference numerals are attached to the same elements and an overlapping description will be omitted. The solid cosmetic material container is provided with a solid cosmetic material, for example, a cheek rouge or the like and is provided for applying it.

Figure 2:
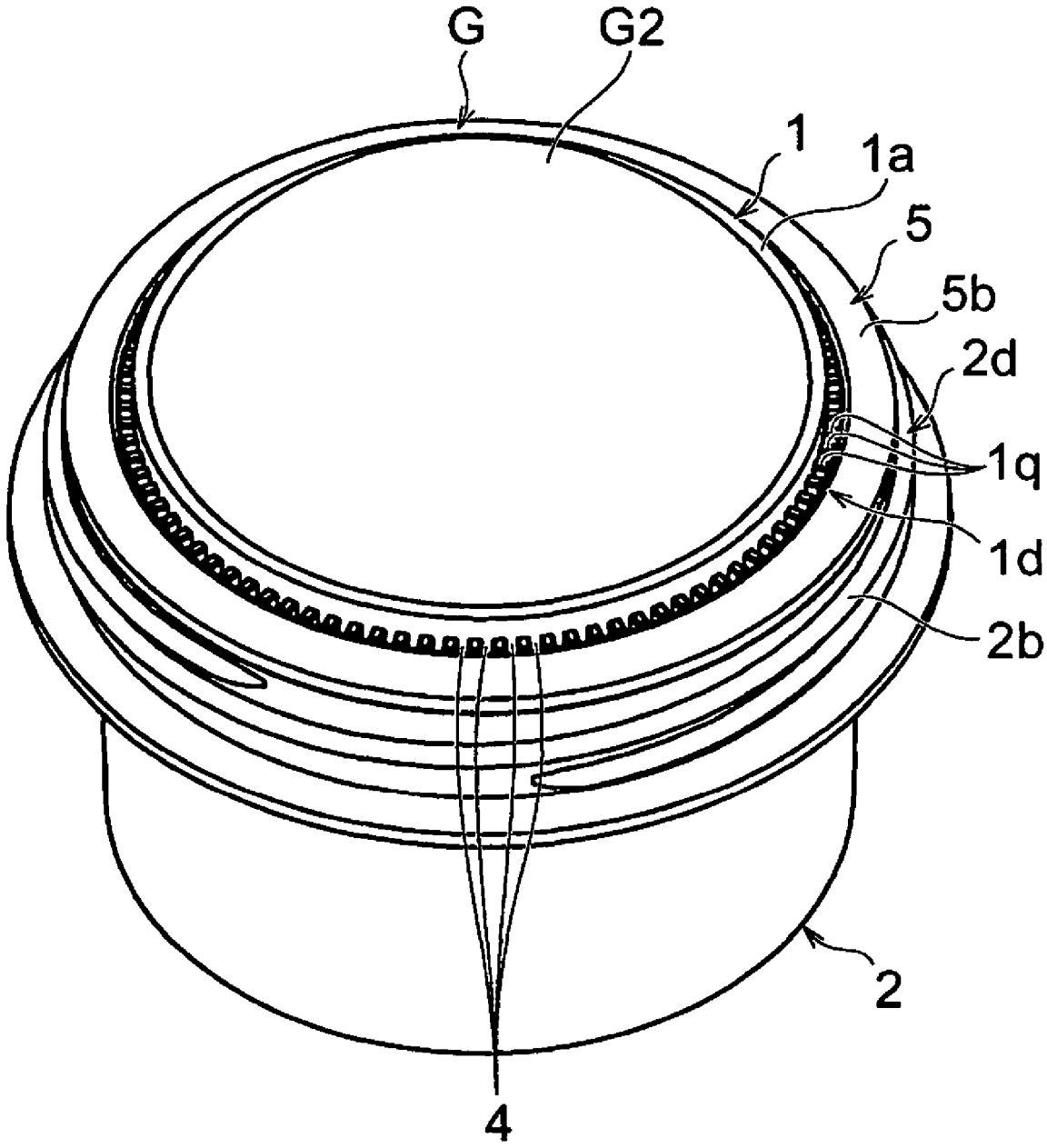
FIG. 2 is a perspective view showing a state in which a cap of the solid cosmetic material container in FIG. 1 is detached.
Figure 3:
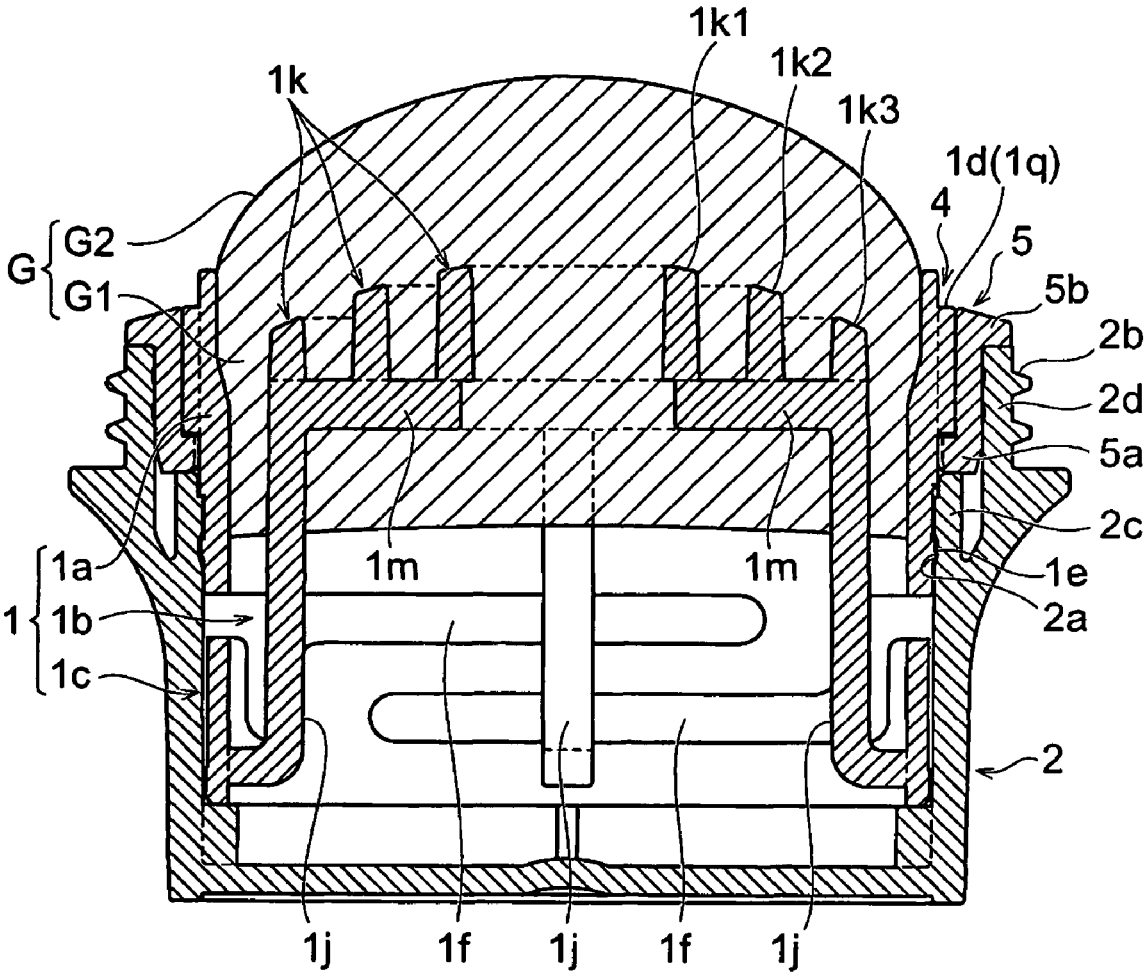
FIG. 3 is a vertical sectional view of the solid cosmetic material container shown in FIG. 2.
Figure 4:
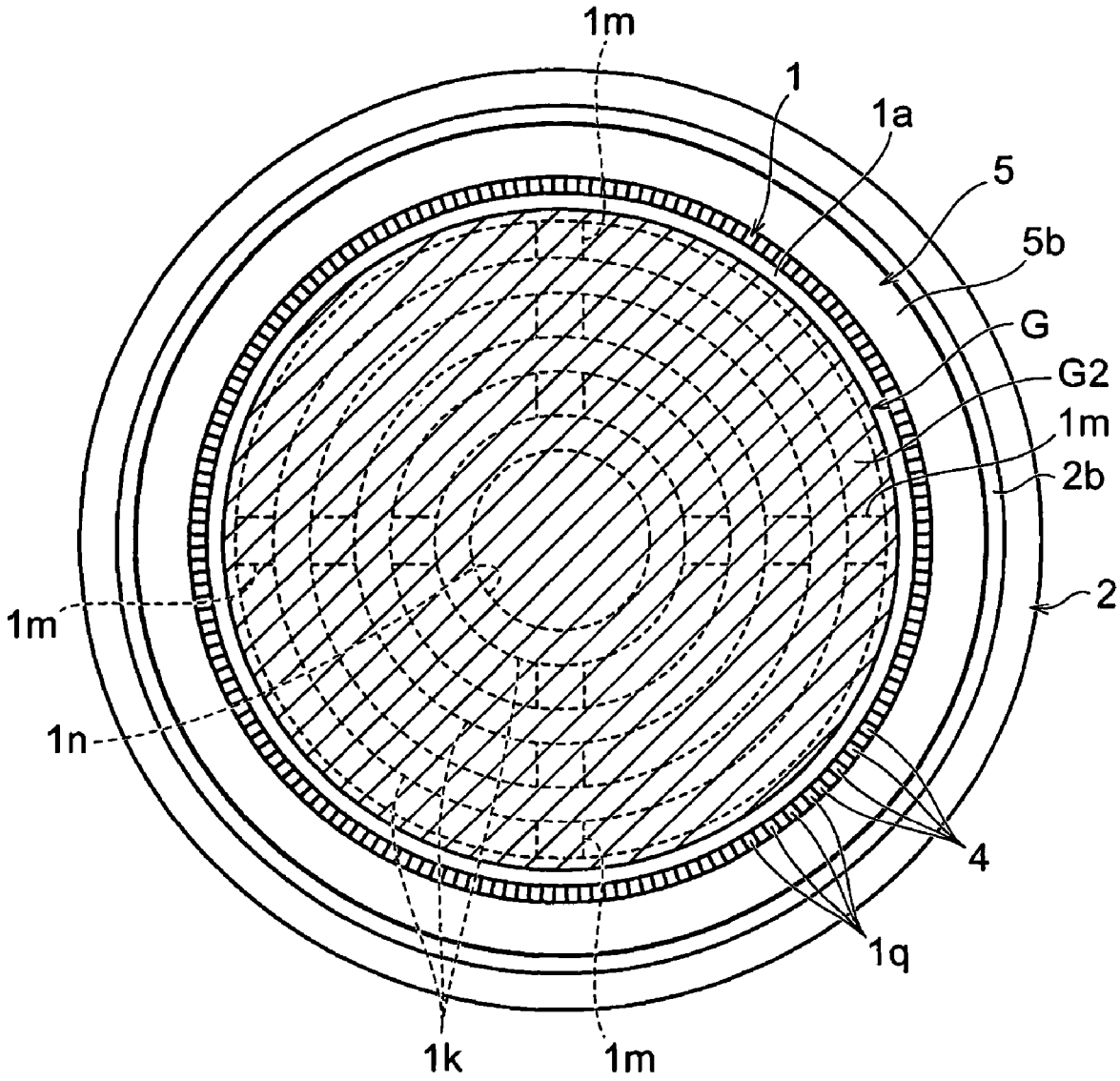
FIG. 4 is a plan view of the solid cosmetic material container shown in FIG. 2.

A solid cosmetic material container 100 shown in FIG. 1 is provided with a solid cosmetic material G, and a solid cosmetic material holding body 1 holding the solid cosmetic material G, as shown in FIGS. 2 to 6, and is provided with a container main body 2 in which the solid cosmetic material holding body 1 is installed in an inner portion, and a cap 3 (refer to FIG. 1) covering an upper portion of the container main body 2 in such a manner as to cover the solid cosmetic material G and the solid cosmetic material holding body 1, as shown in FIGS. 2 to 4. These container main body 2, the solid cosmetic material holding body 1 and the cap 3 are constituted by a molded product made of a resin.

The solid cosmetic material G is formed in a gel state (a jelly state), is a product that a gelatinizer, for example, an agar, a carrageen or the like and a water-soluble dyestuff are blended, and has a water separation property. In this case, it is possible to blend a moisture retention agent, a fine particle, a surface active agent and an oil component to the gel solid cosmetic material as occasion demands. In addition thereto, it is possible to appropriately blend an additive component which can be generally blended to the cosmetic material, for example, a medical agent component such as an antiseptic, an aroma chemical, a pH adjuster, a whitening component and the like.

Further, the solid cosmetic material G is structured, as shown in FIGS. 2 to 6, such as to have an approximately cylindrical base portion G1 and a dome-shaped (including an approximately semispherical shape, an approximately spherical rod shape and the like) convex portion G2 bulging upward from the base portion G1.

Figure 7:
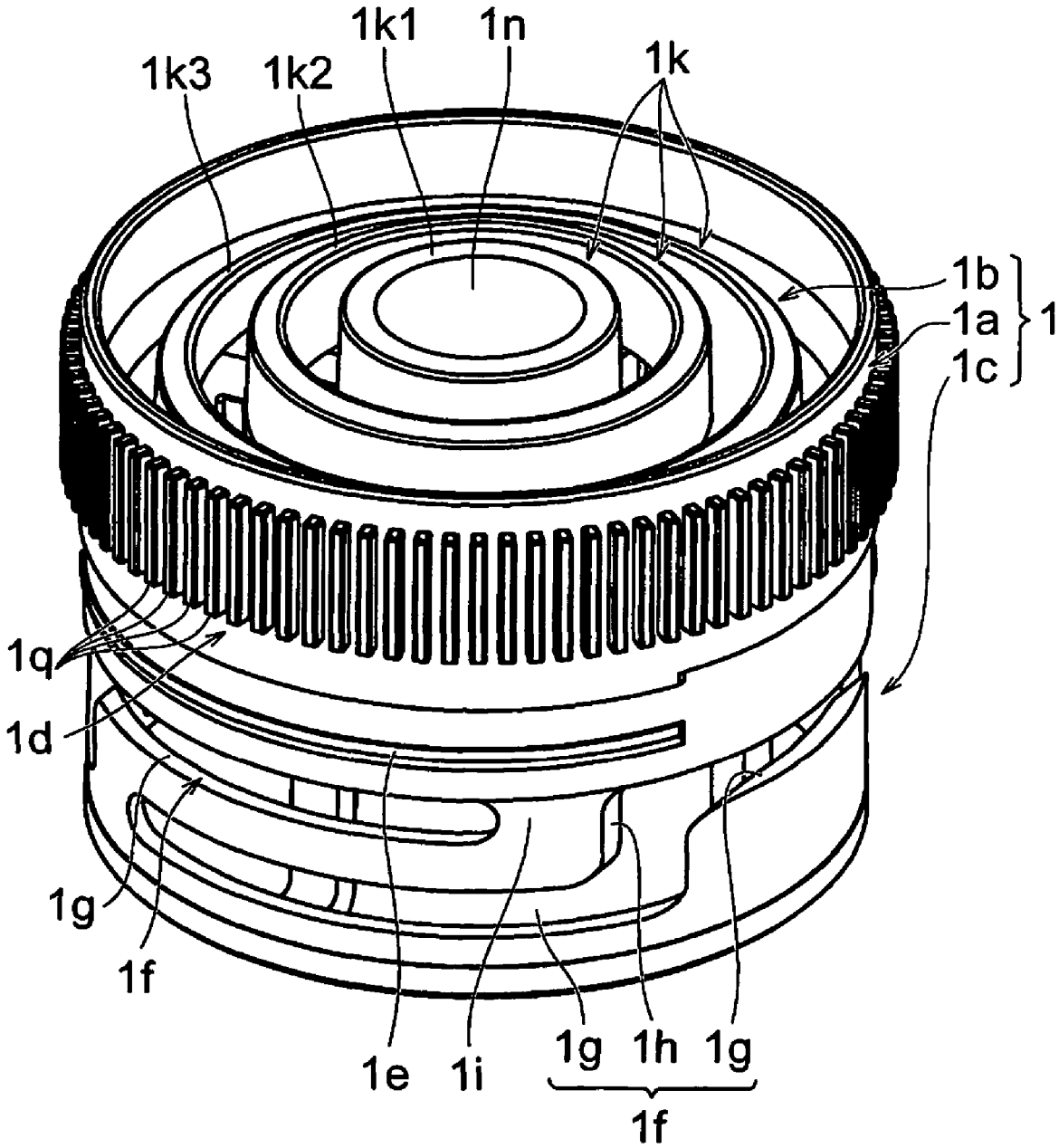
FIG. 7 is a perspective view showing the solid cosmetic material holding body in FIG. 5 from an upper side.
Figure 8:
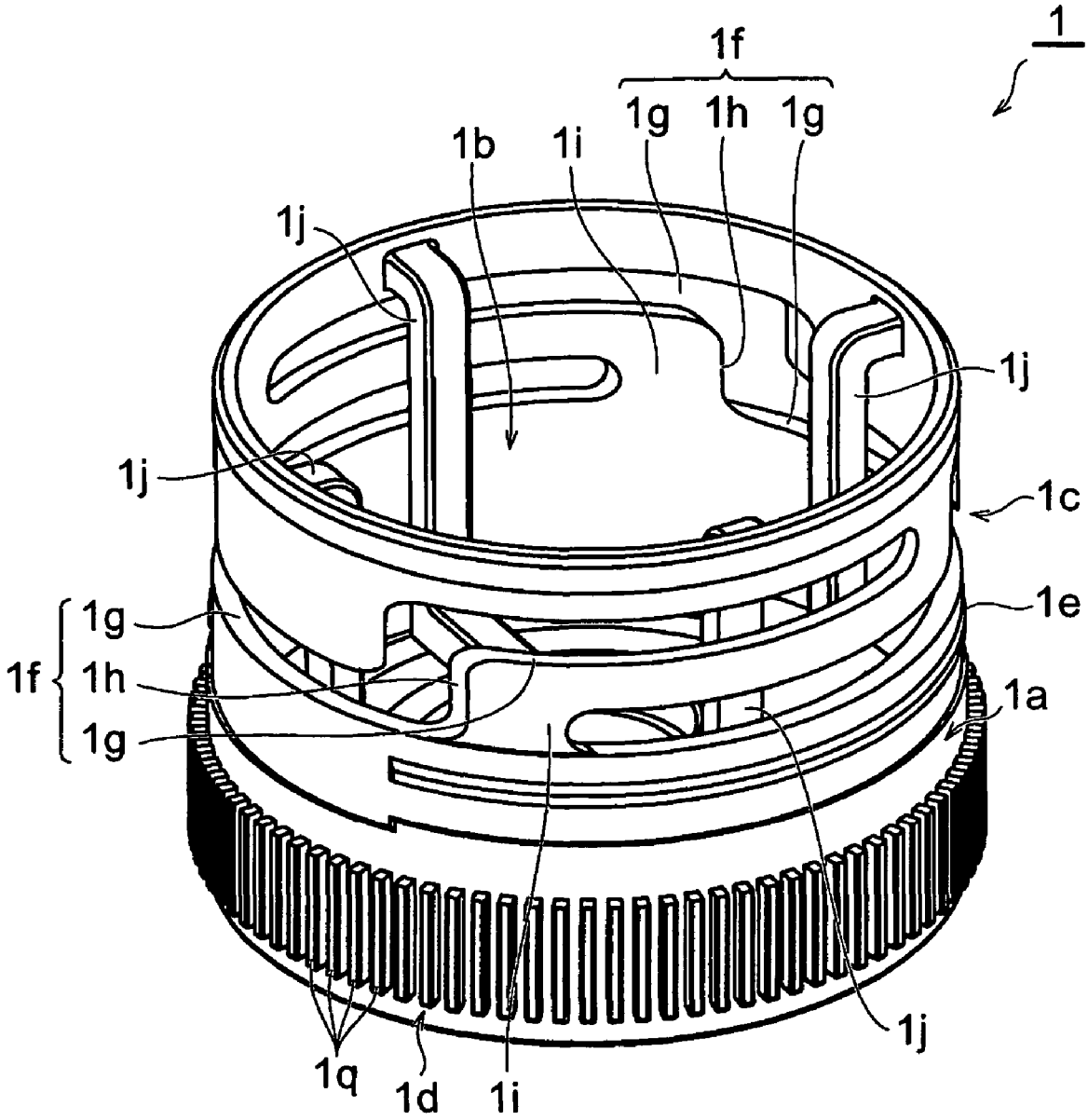
FIG. 8 is a perspective view showing the solid cosmetic material holding body in FIG. 7 in a reverse manner from the upper side.

As shown in FIGS. 3, 7 and 8, the solid cosmetic material holding body 1 is formed as an integrally molded product which is provided with an installed portion 1*a* installed in the container main body 2, a holding portion 1*b* arranged in an inner side of the installed portion 1*a* and holding the solid cosmetic material G, and an elastic body 1*c* arranged in a lower side of the installed portion 1*a* and connecting the installed portion 1*a* and the holding portion 1*b*, and is made of a resin.

As shown in FIGS. 5 to 8, the installed portion 1*a* is formed in an approximately cylindrical shape, and has a concavo-convex portion 1*d* continuously provided along a peripheral direction and extending at a predetermined length in a vertical direction, in an outer peripheral surface of the installed portion 1*a*. The concavo-convex portion 1*d* is constituted by a lot of convex portions 1*q* which are provided along a peripheral direction apart from each other at a predetermined interval, and is for a purpose to structure a drop portion 4 of water separated from the solid cosmetic material G. Further, a plurality of protrusions 1*e* for installing in the container main body 2 are provided in an outer peripheral surface of the installed portion 1*a*, along a peripheral direction in a lower side of the concavo-convex portion 1*d*.

The elastic portion 1*c* is structured in an approximately cylindrical shape having the same diameter as a lower portion of the installed portion 1*a*, and is formed as a resin spring having a slit 1*f* in which a peripheral wall is opened. As shown in FIGS. 7 and 8, the slit 1*f* is structured such that lateral openings 1*g* extending in a lateral direction are arranged in upper and lower sides and arranged so as to be shifted in a lateral direction, and vertically adjacent end portions of the lateral openings 1*g* and 1*g* are connected to each other by a vertical opening 1*h* extending in a vertical direction. Two slits 1*f* are provided along a peripheral direction, and are arranged such that the lateral opening 1*g* in a lower side of the other slit 1*f* is positioned so as to be in parallel to a lower side of the lateral opening 1*g* in an upper side of one slit 1*f*, and the lateral opening 1*g* in an upper side of the other slit 1*f* is positioned so as to be in parallel to an upper side of the lateral opening 1*g* in a lower side of one slit 1*f*. As shown in FIG. 8, the resin spring 1*c* is supported at two points to the lower portion of the installed portion 1*a* at positions apart from each other at 180 degrees in the peripheral direction (a position between the lateral opening 1*g* in the upper side of one slit 1*f* and the vertical opening 1*h* of the other slit 1*f*, and a position between the lateral opening 1*g* in the upper side of the other slit 1*f* and the vertical opening 1*h* of one slit 1*f*) 1*i* and 1*i*. The resin spring 1*c* structured as mentioned above can expand and contract in the vertical direction by the slits 1*f* and 1*f*.

The holding portion 1*b* is provided with a plurality of (four in the present embodiment) legs 1*j* which extend in a vertical direction and a rearranged uniformly apart from each other in a peripheral direction. The leg 1*j* has a rigidity, and a lower portion of the holding portion 1*b* is bent to an outer side so as to be connected to a lower portion of the resin spring 1*c*, in detail, a lower portion than the slit 1*f* of the resin spring 1*c*.

Figure 6:
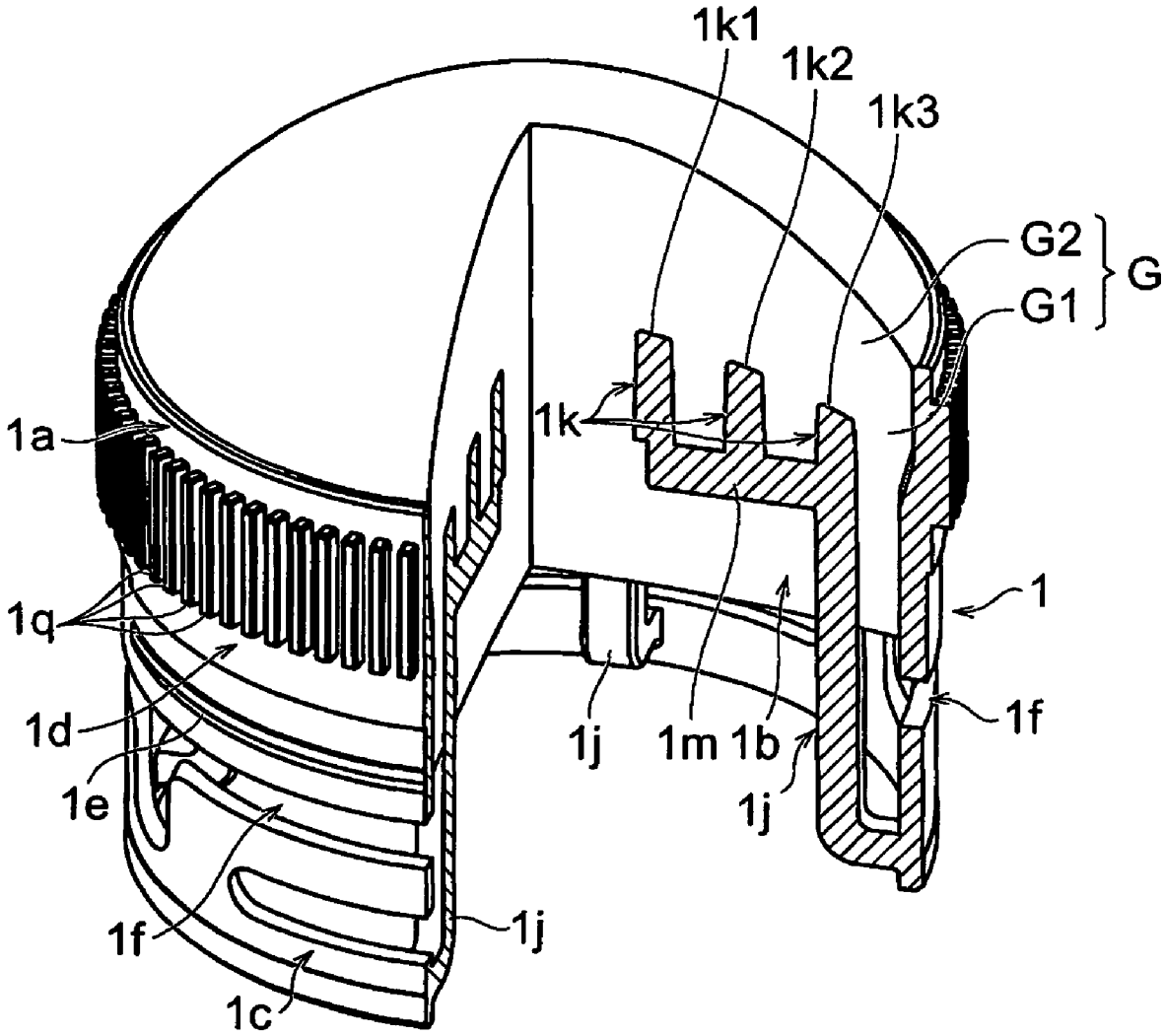
FIG. 6 is a partly broken perspective view of the solid cosmetic material and the solid cosmetic material holding body shown in FIG. 5.

Further, as shown in FIGS. 3, 4, 6 and 7, an upper portion of the leg 1*j* is provided with a circular ring shaped holding body 1*k* and a radial holding body 1*m*. A plurality of (three in the present embodiment) circular ring shaped holding bodies 1*k* are coaxially arranged. The adjacent circular ring shaped holding bodies 1*k* and 1*k* are structured, as shown in FIGS. 3, 6 and 7, such that the inner side circular ring shaped holding body is higher to the upper portion side, in particular, as shown in FIGS. 6 and 7, as inclined surfaces in which an upper surface 1*k*2 of the middle side circular ring shaped holding body 1*k* is lower in comparison with an upper surface 1*k*1 of the innermost side circular ring shaped holding body 1*k*, an upper surface 1*k*3 of the outermost side circular ring shaped holding body 1*k* is lower in comparison with the upper surface 1*k*2 of the middle side circular ring shaped holding body 1*k*, and the upper surfaces 1*k*1, 1*k*2 and 1*k*3 are inclined downward toward an outer side at approximately the same angle and are apart from each other in upper surfaces. Further, as shown in FIGS. 4 and 7, an opening in surrounded by the innermost circular ring shaped holding body 1*k* provided with the upper surface 1*k*1 is set as a filling port to which a gel solid cosmetic material in a solution state mentioned below is poured.

A plurality of (four in the present embodiment) radial holding bodies 1*m* extend radially from the innermost circular ring shaped body 1*k* while being coupled to the lower portion of the innermost circular ring shaped holding body 1*k* provided with the upper surface 1*k*1, respectively couple the lower portion of the other circular ring shaped bodies 1*k*, and are structured such that an outer end portion thereof is coupled to an upper end portion of the vertically extending portion of the leg 1*j*.

Further, the circular ring shaped and radial holding bodies 1*k* and 1*m* constituting the upper portions of the legs 1*j* are set in a state of being covered by the base portion G1 of the solid cosmetic material G, and are structured such as to hold the solid cosmetic material G, as shown in FIG. 3.

Figure 5:
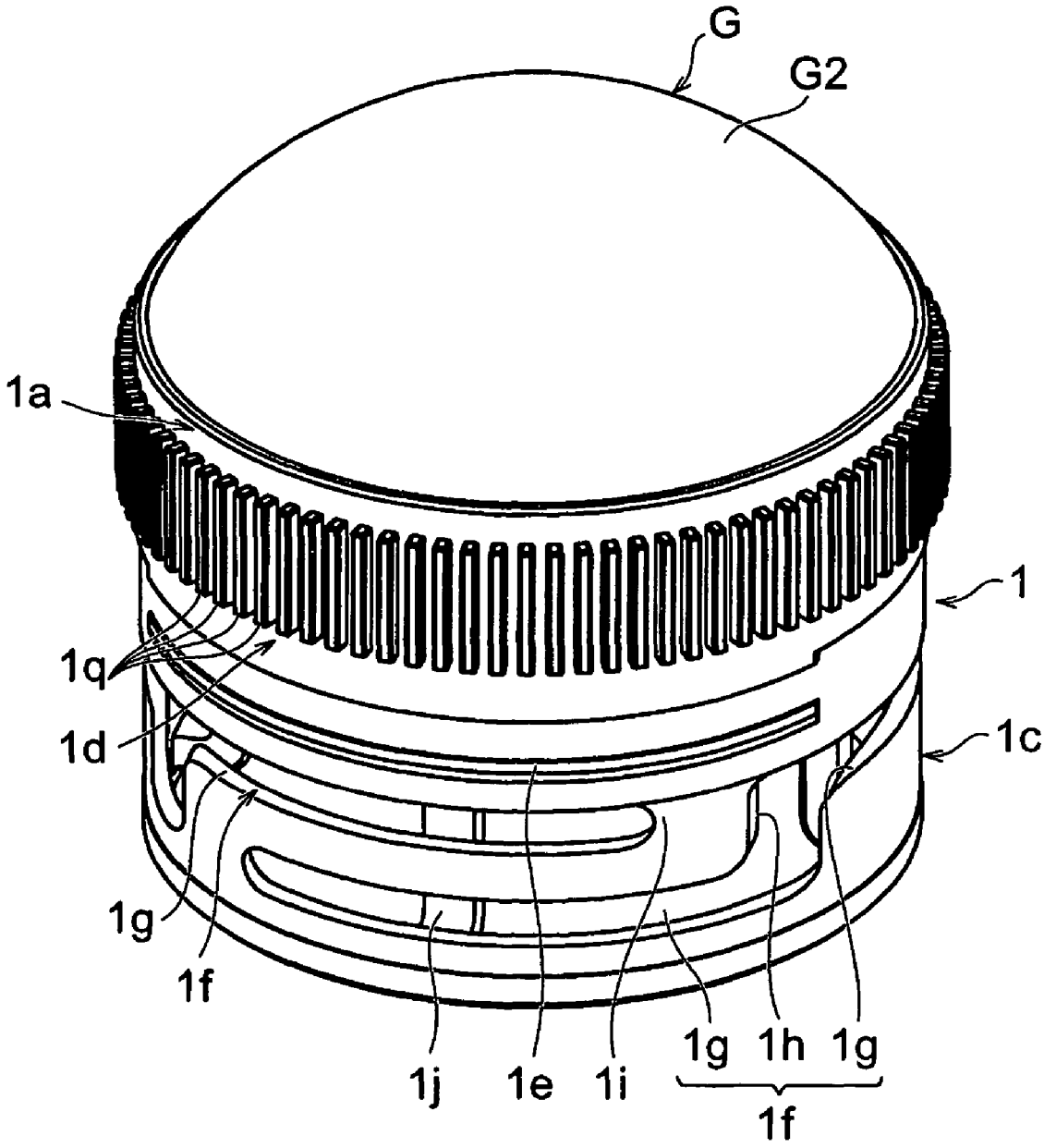
FIG. 5 is a perspective view showing a solid cosmetic material and a solid cosmetic material holding body in FIGS. 2 to 4.

In this case, in order to obtain the solid cosmetic material G having the dome-shaped convex portion G2 and held by the solid cosmetic material holding body 1, the gel solid cosmetic material G having the dome-shaped convex portion G2 is formed by reversing the solid cosmetic material holding body 1 as shown in FIG. 8, fitting to a mold (a rouge mold) having a shape corresponding to (coinciding with) the dome-shaped convex portion G2 from the upper side, pouring the gel solid cosmetic material in a thermally dissolving state to a molding space defined between the mold and the solid cosmetic material holding body 1 through the filling port (the opening) 1*n* of the solid cosmetic material holding body 1 from a filling nozzle arranged in an upper side of the mold until the circular ring shaped and radial holding bodies 1*k* and 1*m* of the solid cosmetic material holding body 1 are covered, solidifying the cosmetic material in the dissolving state and releasing the mold, whereby it is possible to obtain the solid cosmetic material holding body 1 shown in FIGS. 5 and 6 and structured such as to hold the solid cosmetic material G in the circular ring shaped and radial holding bodies 1*k* and 1*m*. Further, the solid cosmetic material G held in the solid cosmetic material holding body 1 can be vertically moved with respect to an inner peripheral surface of the installed portion 1*a* of the solid cosmetic material holding body 1.

The container main body 2 in which the solid cosmetic material holding body 1 mentioned above is installed is formed in a closed-end cylindrical shape, and is structured such that an upper portion thereof is branched into two so as to protrude to an upper side. An annular groove 2*a* for engaging the protrusion 1*e* of the solid cosmetic material holding body 1 in an axial direction is provided in an inner peripheral surface of an upper portion 2*c* in an inner side of the container main body 2, and a male thread 2*b* for detachably installing the cap 3 is provided in an outer peripheral surface of an upper portion 2*d* in an outer side thereof. Further, the solid cosmetic material holding body 1 mentioned above is inserted into the container main body 2 from a lower portion side thereof, is coupled so as to be immobile in an axial direction on the basis of an engagement of the protrusion 1*e* of the solid cosmetic material holding body 1 with the annular groove 2*a* of the container main body 2, and is structured such that the dome-shaped convex portion G2 protrudes upward.

Further, a packing 5 is provided between the solid cosmetic material holding body 1 and the container main body 2, as shown in FIGS. 2 to 4. The packing 5 is constituted by a circular ring shaped body, and is structured, as shown in FIG. 3, such that a lower portion thereof is formed as a bent lower portion 5*a* which is bent inward and an upper portion is formed as a bent upper portion 5*b* which is bent outward. The packing 5 is structured such that an outer peripheral surface is fitted to an inner peripheral surface of the upper portion 2*d* in the outer side of the container main body 2, and an inner peripheral surface faces to the concavo-convex portion 1*d* of the solid cosmetic material holding body 1 from an outer peripheral side, the bent lower portion 5*a* is pinched between a lower end surface of the convex portion 1*q* of the concavo-convex portion 1*d* of the solid cosmetic material holding body 1 and an upper end surface of the upper portion 2*c* in the inner side of the container main body 2, and the bent upper portion 5*b* is mounted on an upper end surface of the upper portion 2*d* in the outer side of the container main body 2.

Since a predetermined rotational frictional resistance is generated between the inner peripheral surface of the bent lower portion 5*a* of the packing 5 and the outer peripheral surface of the installed portion 1*a* of the solid cosmetic material holding body 1, the solid cosmetic material holding body 1 is non-rotatably coupled to the container main body 2 via the packing 5. In other words, the solid cosmetic material holding body 1 is installed in such a manner as to be non-rotatable and non-breakaway in the axial direction with respect to the container main body 2.

Further, as shown in FIGS. 2 and 4, the convex portion 1*q* of the concavo-convex portion 1*d* of the solid cosmetic material holding body 1 is brought into contact with the inner peripheral surface of the packing 5, and a lot of holes extending in the vertical direction along the peripheral direction are formed between the concave surface of the concavo-convex portion 1*d* of the solid cosmetic material holding body 1 and the inner peripheral surface of the packing 5. These holes structure the drop portion 4 into which the water separated from the solid cosmetic material G flows. The drop portion 4 is formed so as to have a hole diameter which can hold the flowing-into separated water on the basis of a capillary operation.

In this case, as shown in FIG. 3, in an inner peripheral surface of the bent lower portion 5*a* of the packing 5, there may be provided a lot of concavo-convex portions continuously arranged along a peripheral direction and extending in a vertical direction, and the drop portion 4 may be formed as vertically extending through holes by the concave portions of the concavo-convex portion 1*d* of the solid cosmetic material holding body 1 and concave portions of the inner peripheral surface of the bent lower portion 5*a* of the packing 5. Further, the drop portion 4 may be formed as downward depressed concave portions without forming the concave portions in the inner peripheral surface of the bent lower portion 5*a* of the packing 5.

Further, the cap 3 is provided with a dome-shaped cover portion 3*a* facing to the solid cosmetic material G and covering the solid cosmetic material G from the upper side, and a circular ring shaped peripheral wall portion 3*b* continuously provided in a peripheral edge of the cover portion 3*a* and extending to a lower side, as shown in FIG. 1. Further, the cap 3 is structured such that the peripheral wall portion 3*b* is fitted outside the upper portion of container main body 2, and a female thread (not shown) provided in the inner peripheral surface of the peripheral wall portion 3*b* is screwed to the male thread 2*b* of the container main body 2, whereby the cap 3 is detachably installed to the container main body 2. In this installed state of the cap 3, a circular ring shaped convex portion (not shown) protruding toward a lower side in an inner side from the peripheral wall portion 3*b* in the cap 3 is brought into contact with the upper end surface of the packing 5, whereby an airtightness is achieved.

In the case the that solid cosmetic material container 100 structured in the manner mentioned above is provided for use, it may be used by detaching the cap 3 from the container main body 2, holding the outer peripheral surface of the container main body 2 and applying the dome-shaped convex portion G2 of the gel solid cosmetic material G to the skin. At a time of this application, since the gel solid cosmetic material G is soft, a use feeling is good. Further, since a cool feeling can be applied particularly in summer season or the like, the use feeling can be further improved.

Further, particularly in accordance with the solid cosmetic material container 100 of the present embodiment, as shown in FIG. 3, the solid cosmetic material holding body 1 provided with the installed portion 1*a*, the elastic portion 1*c* and the holding portion 1*b* is installed in the inner portion of the container main body 2, the installed portion 1*a* is formed in the tubular shape so as to be installed in the container main body 2, the elastic portion 1*c* is formed in the tubular shape so as to be connected to the lower side of the installed portion 1*a* and is formed as the resin spring freely expanding and contracting in the vertical direction while having the slit 1*f* in which the peripheral wall is opened, and the holding portion 1*b* is arranged in the inner side of the installed portion 1*a* and is provided with a plurality of legs 1*j* extending in the vertical direction and arranged apart from each other in the peripheral direction. The upper portions of the legs 1*j* hold the solid cosmetic material G having the dome-shaped convex portion G2 in such a manner that the convex portion G2 protrudes upward, and the lower portions of the legs 1*j* are structured such as to be coupled to the lower portion of the resin spring 1*c*. Accordingly, in the case that the external force such as the impact, the vibration or the like, for example, due to the drop or the like is applied, the external force transmitted to the solid cosmetic material G from the container main body 2 is buffered by the resin spring 1*c* of the solid cosmetic material holding body 1 between the container main body 2 and the solid cosmetic material G. Therefore, it is possible to prevent the crack or the chip of the solid cosmetic material G, and prevent breaking away of the solid cosmetic material G from the container.

Further, in the present embodiment, since the solid cosmetic material holding body 1 is formed as the integral molded product by the resin, it is possible to reduce a manufacturing cost for molding, assembling or the like.

Further, since the present embodiment aims at the gel solid cosmetic material G which tends to crack and chip easily in comparison with the solid cosmetic material including the fine particle and further including the oil and the wax, it is particularly effective to employ the structure of preventing the crack and chip of the solid cosmetic material.

In this case, the lower end surface of the resin spring 1*c* constituting the solid cosmetic material holding body 1 may be previously brought into contact with the bottom portion of the container main body 2 in order to prevent the solid cosmetic material G from moving backward at a time of applying the gel solid cosmetic material G, or the lower end surface of the resin spring 1*c* and the bottom portion of the container main body 2 may be apart from each other as far as the application is not obstructed, for example, the structure that the spring property of the resin spring 1*c* is strong and the gel solid cosmetic material G is depressed before the resin spring 1*c* is expanded at a time of applying.

Further, particularly in accordance with the solid cosmetic material container 100 of the present embodiment, the following operations and effects can be achieved. Since the gel solid cosmetic material G has the water separation property, the separated water flows out from the solid cosmetic material G. Since the solid cosmetic material G has the convex portion G2 bulging upward, the separated water flows downward along the convex surface of the convex portion G2, and reaches the upper surface of the solid cosmetic material holding body 1 surrounding, accommodating and holding the base portion G1 of the solid cosmetic material G.

In this case, if the drop portion 4 in accordance with the present embodiment is not provided, the separated water reaching the upper surface of the solid cosmetic material holding body 1 from the solid cosmetic material G reaches the male thread 2*b* provided in the outer peripheral surface of the upper portion 2*d* in the outer side of the container main body 2 by detaching the cap 3, and is attached to the outer surface of the container such as the packing 5, the solid cosmetic material holding body 1 or the like in addition to the male thread 2*b* so as to be solidified.

However, in the present embodiment, the separated water flowing out from the solid cosmetic material G and flowing along the upper surface of the solid cosmetic material holding body 1 flows into the drop portion 4 provided along the peripheral direction and is held on the basis of the capillary effect of the drop portion 4. Accordingly, it is possible to prevent the separated water from the solid cosmetic material G from being attached to the outer surface of the container without the provision of the independent member such as a water absorption body, whereby an outer appearance is improved and it is possible to prevent a hand or the like from being got dirty. As a result, a commercial value is increased in view of the outer appearance and the use while cost reduction being achieved. In this case, in accordance with the capillary effect by the drop portion 4, the separated water held by the drop portion 4 does not drop down even if the solid cosmetic material container 100 is inverted.

Figure 9:
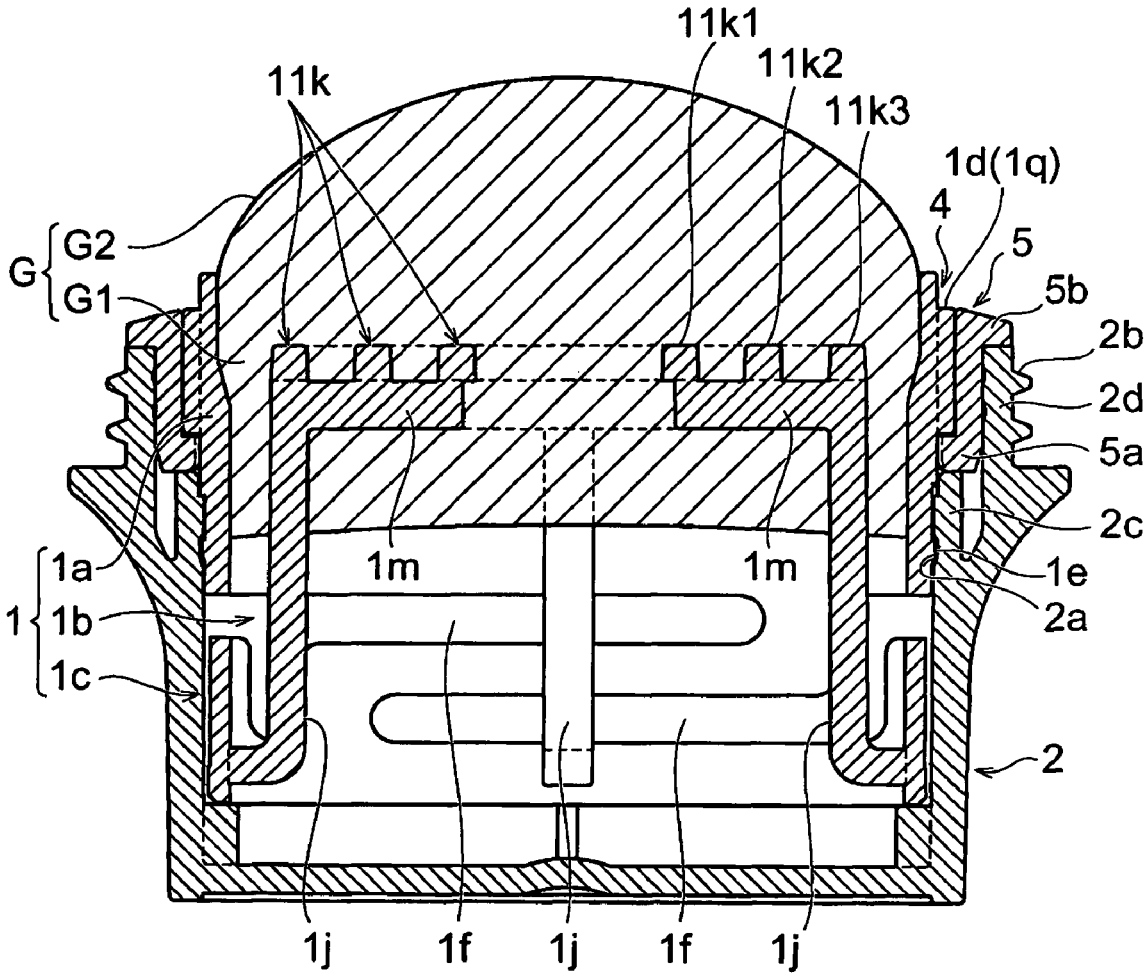
FIG. 9 is a vertical sectional view of a solid cosmetic material container showing another embodiment of a circular ring shaped holding body.
Figure 10:
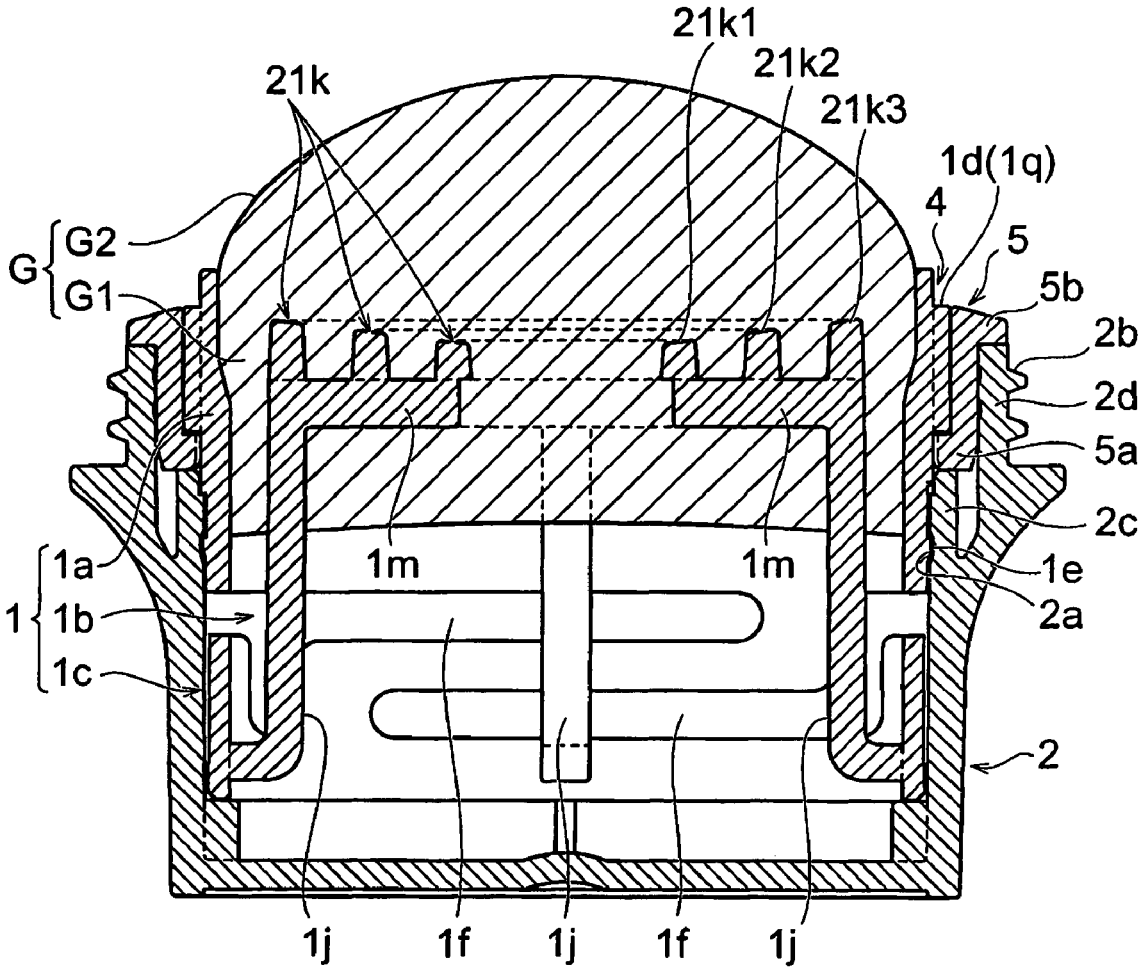
FIG. 10 is a vertical sectional view of a solid cosmetic material container showing further another embodiment of the circular ring shaped holding body.

In this case, in order to approximately uniformly disperse the force applied to the circular ring shaped holding body from the approximately center upper portion of the solid cosmetic material G at a time of applying the solid cosmetic material G in each of the circular ring shaped holding bodies, it is possible to employ a circular ring shaped holding body 11*k* with an outermost side upper surface 11*k*3, a middle side upper surface 11*k*2 and an innermost side upper surface 11*k*1 having approximately the same height, as shown in FIG. 9, in place of the circular ring shaped holding body 1*k* in which the height becomes higher toward the inner side. Further, as shown in FIG. 10, it is possible to employ a circular ring shaped holding body 21*k* in which a middle side upper surface 21*k*2 is lower in comparison with an outermost side upper surface 21*k*3, and an innermost side upper surface 21*k*1 is lower in comparison with the middle side upper surface 21*k*2.

The description is given particularly above of the present invention on the basis of the embodiments, however, the present invention is not limited to the embodiments mentioned above. For example, in the embodiments mentioned above, since it is possible to obtain the significant effect of preventing the crack and the chip of the solid cosmetic material, the solid cosmetic material is in the gel state which tends to be easily cracked and chipped. However, the present invention can be applied to a solid cosmetic material including, for example, the fine particle and further including the oil and the wax, for example, for a lip, a cheek or the like, in place of the gel state, and it is possible to prevent the crack and the chip of the solid cosmetic material and prevent breaking away of the solid cosmetic material from the container, even in such solid cosmetic material.

What is claimed is:

1. A solid cosmetic material container structured such that a solid cosmetic material holding body holding a solid cosmetic material having a dome-shaped convex portion is installed in an inner portion of a container main body in such a manner that said convex portion is protruded to an upper side, wherein said solid cosmetic material holding body comprises:

an installed portion formed in a tubular shape and installed in said container main body;

a holding portion arranged in an inner side of said installed portion and holding said solid cosmetic materials, said holding portion comprising a plurality of coaxially arranged circular ring shaped holding bodies, a plurality of radial holding bodies extending radially and coupled to lower portions of the circular ring shaped holding bodies, and a plurality of legs extending in a vertical direction and spaced-apart from one another in a peripheral direction; and an elastic body arranged in a lower side of said installed portion and connecting said installed portion and said holding portion, wherein said elastic body is constituted by a resin spring formed in a tubular shape having slits with a peripheral wall opened so as to be expanded and contracted in the vertical direction, and wherein upper portions of said legs are coupled to outer end portions of the radial holding bodies and lower portions of the legs are coupled to a lower portion of said resin spring.

2. The solid cosmetic material container as claimed in claim 1, wherein said solid cosmetic material holding body is constituted by an integrally molded product by a resin.

3. The solid cosmetic material container as claimed in claim 1, wherein said solid cosmetic material is formed in a gel state.

4. The solid cosmetic material container as claimed in claim 2, wherein said solid cosmetic material is formed in a gel state.

* * * * *